United States Patent [19]

Gotchel et al.

[11] 4,064,600

[45] Dec. 27, 1977

[54] METHOD FOR FORMING FIBROUS STRUCTURES

[75] Inventors: Joel Peter Gotchel, Glen Mills, Pa.; Henry James Norton, Wilmington, Del.; Aris C. Spengos, Wallingford, Pa.

[73] Assignee: Scott Paper Company, Philadelphia, Pa.

[21] Appl. No.: 715,138

[22] Filed: Aug. 17, 1976

[51] Int. Cl.[2] ..... D04H 1/00

[52] U.S. Cl. ..... 19/156.3; 19/89

[58] Field of Search ..... 19/155–156.4, 19/88, 89; 264/90

[56] References Cited

U.S. PATENT DOCUMENTS

| | | | |
|---|---|---|---|
| 2,152,901 | 4/1939 | Manning | 19/156.4 X |
| 2,890,497 | 6/1959 | Langdon et al. | 19/89 X |
| 3,051,998 | 9/1962 | Rust, Jr. et al. | 19/156.4 |
| 3,256,569 | 6/1966 | Draving | 19/106 X |
| 3,641,628 | 2/1972 | Fehrer | 19/106 R X |
| 3,862,472 | 1/1975 | Norton et al. | 19/156.3 X |
| 3,900,921 | 8/1975 | Zafiroglu | 19/156.3 |
| 3,918,126 | 11/1975 | Wood | 19/156.3 |
| 3,949,035 | 4/1976 | Dunning et al. | 264/90 |

*Primary Examiner*—Dorsey Newton

*Attorney, Agent, or Firm*—Martin L. Faigus; William J. Foley

[57] ABSTRACT

A method for forming a fibrous structure from a fibrous feed by: (1) directing the feed into engagement with projections on a rotating fiberizing drum for separating fibers from the feed; (2) directing the separated fibers to a release zone at which they are released from the periphery of the drum for subsequent conveyance to a foraminous forming surface upon which the fibrous structure is formed; and (3) sealing the outer periphery of the drum in a region between the fiber release zone and the region in which the fibrous feed is directed into engagement with the fiberizing drum by directing a gas against the outer periphery of the drum with a force component in a direction opposed to the direction of rotation of the drum and at a static pressure of at least about two atmospheres to provide a gas velocity which is sufficiently high to remove air trapped between the projections of the drum as the drum is being rotated. Preferably the fibrous feed includes textile-length fibers greater than 1/4 inch in length, and the method includes the step of providing a seal pad in engagement with the outer periphery of the drum in a region that is spaced apart, in the direction of rotation of the drum, from the region on the outer periphery against which the gas is directed.

11 Claims, 4 Drawing Figures

METHOD FOR FORMING FIBROUS STRUCTURES

BACKGROUND OF THE INVENTION

1. Field of the Invention

This invention relates to an apparatus and method for dry-forming a fibrous structure, and more specifically to an apparatus and method employing a unique seal arrangement to prevent the loss of fibers during high speed formation of the fibrous structure.

2. Description of the Prior Art

Low basis weight nonwoven fibrous webs in the basis weight range of from about 1 oz/yd$^2$ to about 6 oz/yd$^2$ are becoming extremely popular. Some of these webs are formed predominately of short cellulosic fibers less than one-fourth inch in length, and include a minor proportion, by weight, of longer reinforcing fibers having an average length greater than one-fourth inch. These webs can be used by themselves, or in conjunction with other materials as substitutes for conventional textile fabrics in articles such as disposable diapers, sanitary napkins, industrial and household wipers, cosmetic pads and the like.

U.S. Pat. No. 3,862,472, issued to Norton et al, and assigned to Scott Paper Company, discloses a highly desirable method for dry-forming a low basis weight nonwoven fibrous web which includes short and long fibers which are blended together. In accordance with that method loosely compacted batts of the short and long fibers are directed into a fiber blending device in which the fibers are individualized from their respective batts and blended together to form a fibrous feed mat. The feed mat is directed into a web forming device in which the fibers are again separated into their individual fiber components and redeposited on a forming surface in the form of a fibrous web having a basis weight in the range of from about 1 oz/yd$^2$ to about 6 oz/yd$^2$. The fibrous feed mat has a basis weight at least 3 times the average basis weight of the low basis weight nonwoven fibrous web to be formed, and in all cases, has a basis weight greater than 12 oz/yd$^2$.

A need continuously exists for upgrading processes and apparatus for dry-forming low basis weight nonwoven fibrous webs, and in particular, to achieve faster web forming speeds. By increasing formation speeds dry-forming processes become more competitive with conventional papermaking processes which employ water as the carrying medium for the fibers.

In the Norton et al process the blending operation, in which the individual batts of long and short fibers are separated into their individual fiber components and blended together, has been a significant speed limiting factor in the formation of low basis weight fibrous webs. Specifically, devices of the general type employing a main drum and satellite worker rolls are usable to accomplish the blending operation at low speeds. However, at high-production speeds these prior art devices do not reliably process fibrous material in which the predominate fiber component, by weight, is less than one-fourth inch in length, such as wood pulp fibers and cotton linters. The reason why these prior art devices are unable to handle short fibers at high production speeds is clearly set forth in copending application Ser. No. 715,165, filed on even date herewith, and covering APPARATUS AND METHOD FOR FORMING FIBROUS STRUCTURES invented by Joel P. Gotchel and Henry J. Norton (hereinafter referred to as the "Gotchel-Norton application"). The Gotchel-Norton application is incorporated by reference into the instant application.

The apparatus disclosed in the Gotchel-Norton application is a carding machine adapted for use in the high speed processing of fibrous material in which the predominate fiber component, by weight, is less than one-fourth inch in length. That apparatus includes a unique arrangement of baffles and air control means for permitting a main drum of the apparatus to be rotated with a peripheral speed of over 10,000 feet/minute to blend long and short fibers together in the formation of a fibrous feed mat. The baffles and air control means direct air and fibers along the periphery of the main drum during high speed operation of the device. It was found that the absence of a seal arrangement adjacent the bottom of the main drum resulted in a loss of a considerable percentage (i.e. 10–20%) of the textile-length fibers being processed in the apparatus. These long fibers were dragged by the high speed rotation of the main drum along a lower casing member of the apparatus, and escaped from the apparatus adjacent the inlet section for the fibrous feed. As a result of the loss of long fibers, the percentage of long fibers included in the fibrous feed had to be greater than that which was to be included in the formed mat. This obviously increased the raw material costs associated with the mat forming operation.

U.S. Pat. No. 3,051,998, issued to Rust, Jr. et al, discloses an air seal for preventing fibers from draping over the edge of a formation duct in a dry-forming apparatus. Rust et al indicates that, in the absence of an air seal, an area of stagnant air exists adjacent the edge of the formation duct closest to the toothed cylinder to permit fibers to drape about that edge. In the Rust et al apparatus an air stream is directed through an air-seal counter to the air stream induced by rotation of the toothed cylinder. This displaces the location of stagnant air to a point remote from edge of the formation duct to prevent fibers from contacting and hanging-up on the edge of said duct.

Applicants have found that an air seal, by itself, is not totally effective in preventing an air stream induced by the rotation of a toothed main drum from conveying textile-length fibers around the main drum, under the usual stationary cover, and back to the feed area at which the fibers escape from the apparatus. Rust et al indicate that an acceptable pressure in a nozzle plenum is from 5 inches to 7 inches of water. In the devices and methods of interest to applicants such pressures are not suitable for preventing the main drum from conveying, to the feed area, air which is trapped between the teeth of said main drum. Directing such a flow of air into the feed area disturbs the integrity of the fibrous feed, and causes said feed to move in an intermittent fashion into engagement with the toothed periphery of the main drum. This adversely affects the uniformity of the machine-direction basis weight in the fibrous structure formed from the fibrous feed.

U.S. Pat. No. 3,949,035, issued to Dunning et al, discloses an air-seal arrangement similar to that employed in the Rust et al apparatus. In fact, the flow of air through the air seal in the Dunning et al apparatus is set to prevent the draping of fibers over the upper edge of the formation duct wall, in the same manner as disclosed in the Rust et al patent. The air seal employed in the Dunning et al device is believed to be deficient for the same reasons discussed above in connection with the Rust et al device.

SUMMARY OF THE INVENTION

This invention relates to an apparatus and method for forming a fibrous structure from a fibrous feed. The apparatus includes a rotatable drum having projections, such as teeth, on its outer periphery. The drum is rotatable past an inlet section at which the teeth separate fibers from the fibrous feed. The separated fibers are conveyed to a release zone on the drum, whereat the fibers release from the drum surface for conveyance to a foraminous forming surface upon which the fibrous structure is formed. This invention employs a unique seal arrangement disposed adjacent the outer periphery of the drum between the fiber release zone and the feed means in the direction in which the drum is rotated. The seal arrangement includes a nozzle and a seal pad. The nozzle has an outlet oriented for directing a gas against the outer periphery of the drum with a force component in a direction opposed to the direction of rotation of said drum. The seal pad is spaced from the nozzle in the direction of rotation of the drum and is in engagement with the projections on the outer periphery of said drum. The seal pad creates a back pressure in the region of the main drum adjacent the nozzle to aid in doffing fibers from the teeth of the main drum for conveyance to the forming surface. Directing a gas against the outer periphery of the main drum through the nozzle removes air which is trapped between the teeth of the main drum to prevent that air from being conveyed to the inlet section of the apparatus. If the air were permitted to be conveyed to the inlet section of the apparatus, it would adversely affect uniform movement of the fibrous feed, and thereby adversely affect the uniformity in basis weight of the formed fibrous structure.

The seal arrangement is advantageously employed in the formation of fibrous structures including textile-length fibers over one-fourth inch in length, and is most preferably employed in the apparatus and method described in the earlier-referred-to Gotchel-Norton application.

In the preferred method of this invention a preponderance, by weight, of short cellulosic fibers of a papermaking length less than one-fourth inch is blended with a minor proportion, by weight, of textile-length fibers greater than one-fourth inch by employing the apparatus of this invention. Most preferably the fibrous structure which is formed is a feed mat which is adapted to be directed into a web former to form a low basis weight fibrous web in the basis weight range of from about 1 oz/yd$^2$ to about 6 oz/yd$^2$. The feed mat which is formed in accordance with the preferred embodiment of this invention has a basis weight of at least 12 oz/yd$^2$, and in all cases is at least 3 times the basis weight of the fibrous web which is to be formed. In the most preferred method of this invention the periphery of the main drum is rotated at a surface speed in excess of 10,000 feet per minute, and the static pressure of the gas directed through the nozzle of the seal arrangement is in the range of from about 2 atmospheres to about 4 atmospheres.

Other objects and advantages of this invention will become apparent upon referring to the detailed descriptions which follows, taken in conjunction with the drawings.

DESCRIPTION OF THE PREFERRED EMBODIMENT OF THE INVENTION

This invention relates to an apparatus and method for forming fibrous structures. Most preferably the invention resides in blending papermaking length fibers less than one-fourth inch with longer textile-length fibers to form a fibrous feed mat in which the papermaking length fibers, by weight, are the predominate fiber component. Most preferably the fibrous feed mat formed in accordance with this invention is directed into a web forming device for forming a low basis weight fibrous web in the basis range of from about 1 oz/yd$^2$ to about 6 oz/yd$^2$. A preferred web forming operation is disclosed in the earlier-referred-to Norton et al U.S. patent (No. 3,862,472). The fibrous feed mat formed in accordance with the preferred embodiment of this invention has a basis weight of at least 12 oz/yd$^2$, and is at least 3 times greater than the basis weight of the fibrous web which is formed from it. A unique seal arrangment is employed in the apparatus and method of this invention, and may be suitable for use in the formation of other web structures. However, in accordance with the preferred embodiment of this invention the apparatus is employed to form a fibrous feed mat of blended long and short fibers, as described above. Therefore, details of the present invention will be described in connection with the formation of such a feed mat.

Figure 1:
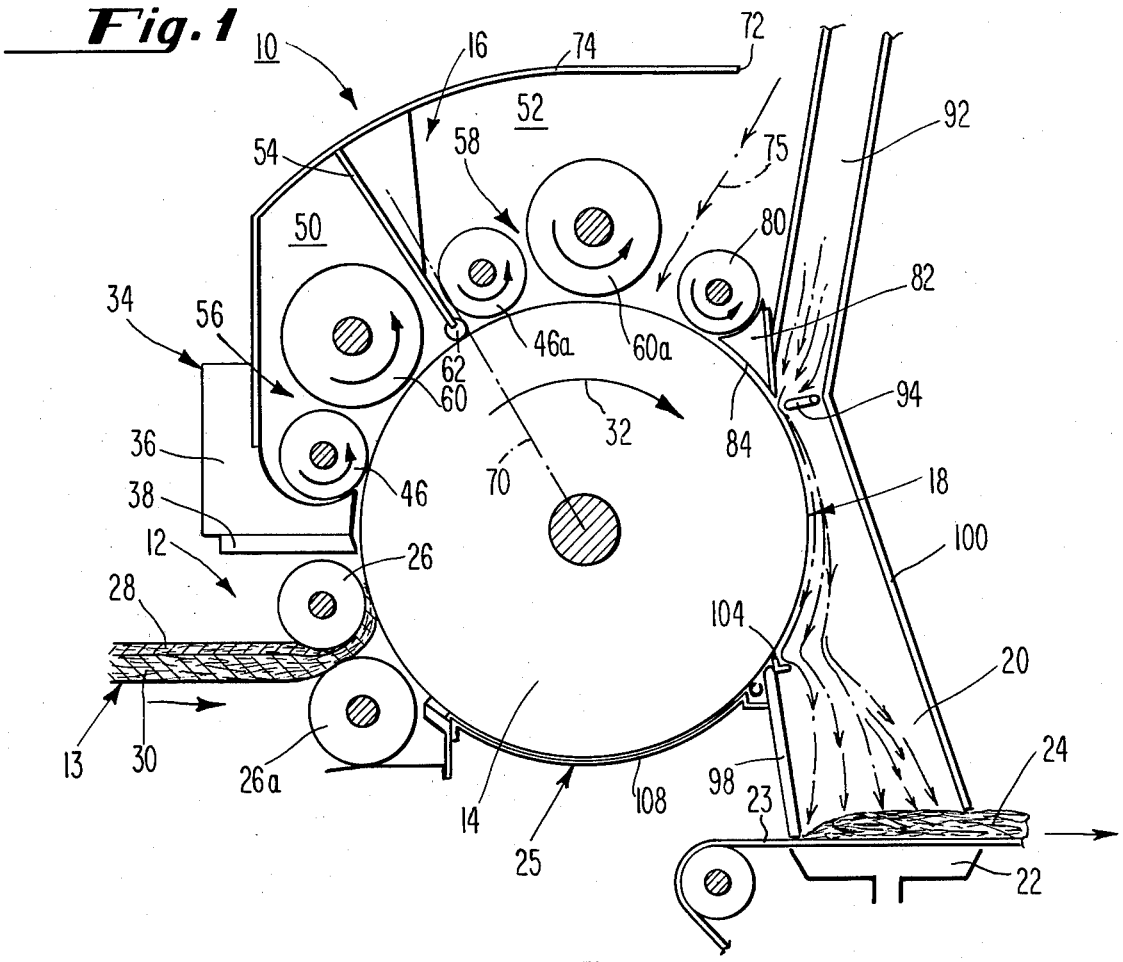
FIG. 1 is a schematic side elevation view of the apparatus of this invention.

Referring to FIG. 1, the preferred apparatus of this invention is indicated at 10, and includes an inlet section 12 through which a fibrous feed 13 is directed into engagement with the toothed periphery of a main drum 14. The main drum 14 separates fibers from the fibrous feed 13, and conveys the separated fibers through a working section 16. The working section 16 is operative to further separate, or individualize the fibers. When different types of fibers are included in the fibrous feed the working section 16 also blends together the individualized fibers. From the working section 16 the outer periphery of the main drum 14 moves to a fiber release zone 18, at which the outer periphery of the drum moves downwardly in a generally vertical direction. A substantial portion of the blended fibers separate from the main drum in the release zone 18 by the action of centrifugal force. Thereafter, the blended fibers are conveyed through a formation chamber 20, and, with the aid of a pressure differential established through vacuum box 22, are deposited on a foraminous forming surface 23 in the form of a fibrous feed mat 24. A unique seal arrangement 25 is positioned adjacent the lower periphery of the main drum 14 between the release zone 18 and the inlet section 12. This seal arrangement 25 reduces the loss of fibers from the apparatus, and also prevents air which is trapped between the teeth of the main drum 14 from being conveyed to the inlet section 12 by the high speed rotation of said main drum. A more detailed description of the seal arrangement 25 is set forth later in this application.

The seal arrangement 25 is disclosed in the earlier-referred-to Gotchel-Norton application, and is identified by the numeral 106 in that application. The seal arrangement was disclosed in the Gotchel-Norton application since it represents the best mode for employing the invention which is claimed therein. However, it should be emphasized that the seal arrangement 25 is the joint invention of Joel P. Gotchel, Henry J. Norton and Aris Spengos.

Upper and lower feed rolls 26 and 26a, respectively, are provided at the inlet section 12 for engaging the opposed flat surfaces of the feed 13 to direct said feed into engagement with the periphery of the main drum 14. In accordance with the preferred use of this invention the fibrous feed 13 includes textile-length fibers over one-fourth inch in length, and most preferably is a laminate including a loosely compacted upper layer 28 of the textile-length fibers, and a loosely compacted lower layer 30 of short cellulosic fibers of a papermaking length less than one-fourth inch. In the preferred embodiment of this invention the textile-length fibers which are employed are either rayon or polyester; however, the specific long fiber component is not considered to be a limitation on the present invention. The preferred short fiber component is wood pulp because it is readily available, relatively economical and highly absorbent. Absorbency is particularly important when the fibrous mat, or a low basis weight fibrous web formed from said mat, is intended to be used for applications requiring the retention of liquids. Other short fibers, such as cotton linters, can also be employed in this invention; the particular short fiber component not being considered a limitation on the broader aspects of the invention.

Figure 2:
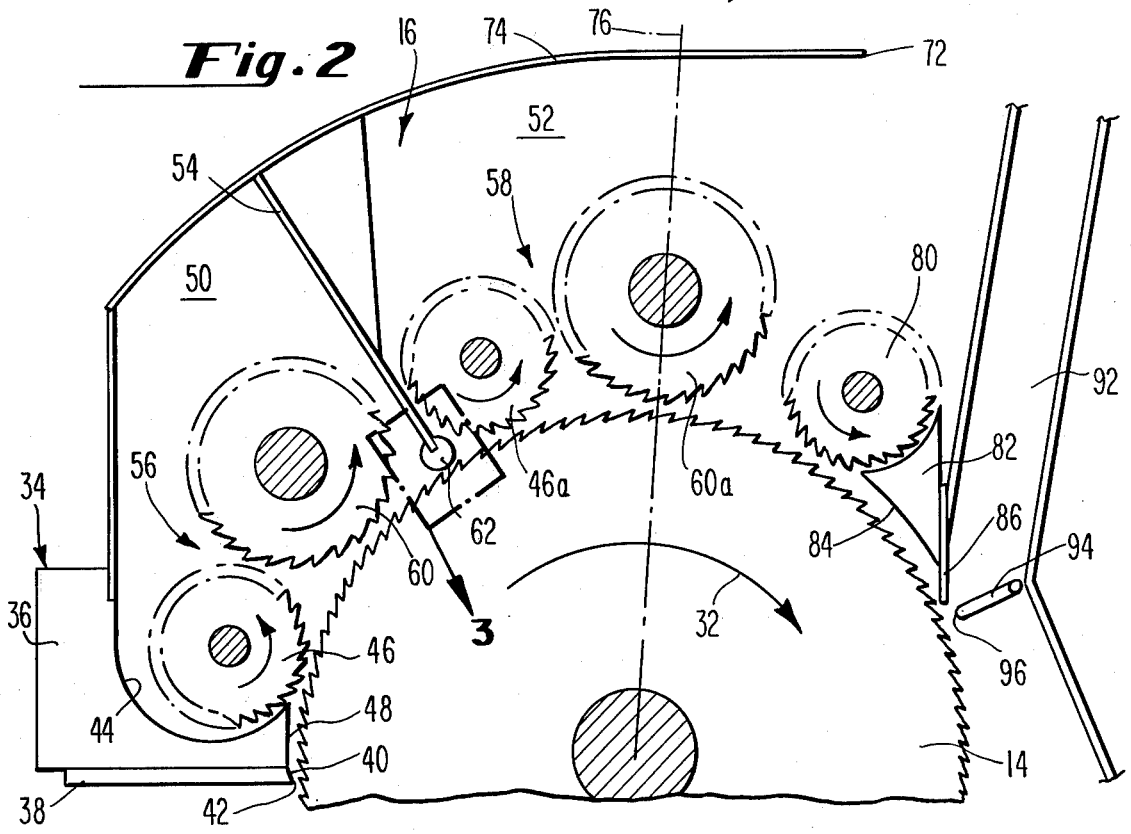
FIG. 2 is an enlarged side elevation view of a portion of the apparatus shown in FIG. 1, showing further details of construction.

The main drum 14 includes projections in the form of teeth on its outer periphery. The main drum is rotated in a clockwise direction, as indicated by arrow 32, preferably at a surface speed greater than 10,000 feet/minute. Most preferably the main drum 14 is rotated at a surface speed of about 13,000 feet/minute. In a preferred construction of the invention the main drum is 24 inches in diameter, and is rotated at about 2,100 rpm. This corresponds to a peripheral surface speed of about 13,200 feet/minute. The teeth on the outer periphery of the main drum 14 have a positive rake (FIG. 2). That is, the teeth are inclined in the direction of rotation of the main drum so that they are oriented to hook the fibers of the fibrous feed 13 as the main drum is advanced past the feed rolls 26 and 26a.

Referring to FIGS. 1 and 2, a feed roll baffle arrangement 34 prevents an excessive quantity of atmospheric air from being pumped through the inlet section 12 by the high speed rotation of the main drum 14. The baffle arrangement 34 includes an upper section 36 and a lower section 38. Most preferably the lower section 38 includes an inclined, or tapered front surface 40 which diverges from the periphery of the main drum in an upward direction, as illustrated in FIGS. 1 and 2. The lower edge 42 of the front surface 40 is positioned considerably less than 0.100 inches from the periphery of the main drum 14, and most preferably is positioned at about 0.004 inches from said periphery. This close spacing between edge 42 and the outer periphery of the main drum 14 acts as a seal to minimized the amount of air which is pumped through the inlet section 12 into the working section 16 by the high speed rotation of said main drum.

The upper section 36 of the baffle arrangement 34 includes a concavely curved top surface 44 which circumscribes a turner roll 46 located in the working section 16 of the apparatus. A front surface 48 of the upper section 36 in positioned close to the main drum 14, and cooperates with the periphery of the main drum for directing the flow of air and fibers along said main drum for passage under the turner roll 46. In the most preferred embodiment of the invention the front surface 48 is spaced about 0.100 inches from the outer periphery of the main drum 14.

Referring to FIGS. 1 and 2, the working section 16, into which fibers are directed by the main drum 14, includes fiber working areas 50 and 52 separated by a baffle plate 54. The working areas 50 and 52 include sets of satellite rolls 56 and 58, respectively. The sets of satellite rolls 56 and 58 are identical in construction, and cooperate with the main drum 14 for individualizing fibers as said fibers are directed through the working section 16. The set of satellite rolls 56, which is the first set encountered by fibers directed into the working section 16, includes a worker roll 60 and the earlier-referred-to turner roll 46. The worker roll 60 and turner roll 46 are positioned close to each other, and close to the periphery of the main drum 14 for cooperating with each other and with the main drum to individualize fibers and to aid in directing said fibers through the working section 16. The turner roll 46 is closer to the main drum 14 than it is to the worker roll 60. The worker roll 60 is closer to the turner roll than it is to the main drum. This positional arrangement sets up a static pressure profile in the working area 50 which encourages the flow of air adjacent the periphery of the main drum. In a preferred embodiment of the invention the peripheries of the turner roll 46 and the main drum 14 are spaced 0.015 inches apart; the peripheries of the turner roll 46 and worker roll 60 are spaced 0.020 inches apart, and the peripheries of the worker roll 60 and main drum 14 are spaced 0.025 inches apart. The worker roll 60 and the turner roll 46 are rotated at substantially the same surface speed, and that surface speed is considerably slower than the surface speed of the main drum 14. For example, the worker and turner rolls preferably are rotated at a surface speed in the range of from about 200 to 300 feet/minute, as compared to a main drum surface speed which preferably is over 10,000 feet/minute.

Referring to FIG. 2, the worker roll 60 is rotated in a counterclockwise direction, and the teeth on the periphery thereof have a negative rake. That is, the teeth are inclined opposite to the direction of rotation of the worker roll 60. The main drum 14, which is rotated considerably faster than the worker roll, moves fibers past the slower moving teeth of said worker roll. Fibers which are not completely individualized as they are separated from the fibrous feed 13 (i.e., clumps of fibers) will extend above the periphery of the teeth of the main drum 14, and will be directed into hooked engagement with the negative rake teeth of the worker roll 60. In view of the fact that the worker roll 60 is rotated at a considerably slower speed than that of the main drum 14, the velocity of the fibers is retarded as they are transferred from the main drum to the worker roll. This retardation aids in combing fibers to individualize them.

The turner roll 46 is rotated in a counterclockwise direction, and the teeth on the periphery thereof have a positive rake. The relationship between the tooth rake and the direction of rotation of the turner roll 46 and the worker roll 60, respectively, causes fibers to be transferred to the turner roll from the worker roll as the peripheries of said rolls move past each other. The positive rake of the teeth on the turner roll 46 precludes the turner roll from lifting fibers off of the main drum 14, and in fact, functions to redeposit fibers on the main drum which have been transferred from said main drum to the worker roll 60. Unseparated groups of fibers which are returned to the main drum 14 by the turner roll 46 can again be worked by the coaction of the main drum 14 and the worker roll 60. Clumps of fibers which escape the action of the first set of satellite rolls 56 will be moved by the main drum 14 into the second working area 52. In the second working area the fibers can again be subjected to further separation, or individualization, by the cooperation of the main drum 14 with the worker roll **60*a* and the turner roll 46*a* of the second set of satellite rolls 58**.

Figure 3:
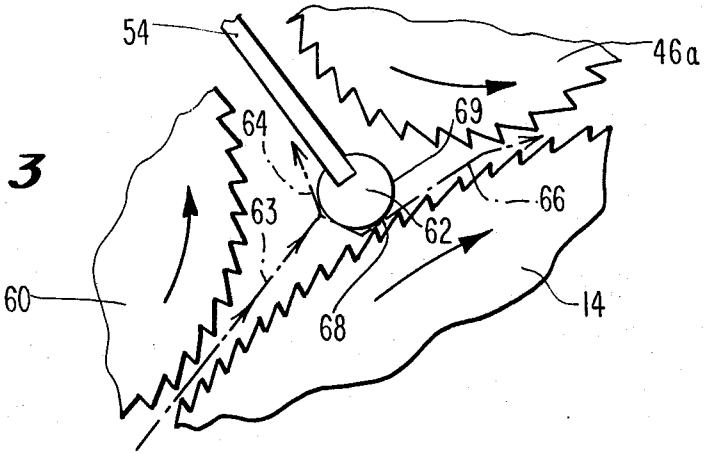
FIG. 3 is an enlarged view of the blocked portion of FIG. 2, identified by the numeral 3.

Referring to FIGS. 1 and 3, the baffle plate 54 includes a lower, substantially cylindrical air-directing section 62 which extends for the entire cross-machine-direction of the apparatus 10. Air is moved toward the air-directing section by the high speed rotation of the main drum 14, as indicated by arrow 63. This air movement is intercepted by an upstream curved section of the air-directing section for splitting the air into separate components indicated by arrows 64 and 66, respectively. The volume of air in the component indicated by arrow 64 is considerably less than the volume of air in the component indicated by arrow 66.

The component of air indicated by arrow 64 is diverted away from the periphery of the main drum 14 into the region between the periphery of the worker roll 60 and the baffle 54. The component of air indicated by arrow 66 is directed through a constricted area 68 provided between the lower end of the air-directing section 62 and the outer periphery of the main drum 14. The constricted area 68 confines the flow of air to the periphery of the main drum 14 so that it will be conveyed between said main drum and the turner roll **46*a* of the second set of satellite rolls 58**.

Diverting a portion of the air in the general direction of arrow 64 increases the static pressure adjacent the downstream end of the worker roll 60. This increase in static pressure reduces the pressure drop from the upstream end of the turner roll 46 to the downstream end of the worker roll. By reducing this pressure drop the air flow will not tend to flow around the turner roll 46 and the worker roll 60 in a direction counter to the direction of rotation of fiber flow on said worker and turner rolls. In fact, the air will tend to stay on the outer periphery of the main drum 14, and be conveyed by the main drum past the turner roll 46 and the worker roll 60 of the first set of satellite rolls 56. It should be appreciated that the earlier-described feed roll baffle arrangement 34 and the static pressure profile set up by the spacing among the turner roll 46, the worker roll 60 and the main drum 14 contribute to directing the air flow along the periphery of the main drum 14 to prevent air flow around the turner roll 46 and the worker roll 60 in a direction counter to the direction of rotation of fiber flow on said worker and turner rolls. Controlling the flow of air so that it is not counter to the direction of fiber flow is most important when the fibrous feed includes short cellulosic fibers under one-fourth inch in length. This manner of controlling the air prevents the short fibers from being prematurely doffed from the turner roll 46 and the worker roll 60. If the short fibers are doffed prematurely from the worker and turner rolls they will group together and form "ropes" of fibers in the working area 50. Such "ropes" jam the apparatus, and thereby cause poor quality of the fibrous mat 24, as well as undesirable machine down time so that the apparatus can be cleaned out.

As explained above, a component of air is also diverted in the direction indicated by arrow 66 through the constricted area 68. After passing the constricted area 68 the air is directed under the turner roll **46*a* of the second set of satellite rolls 58. By controlling the flow of air in this manner the air is prevented from being intercepted by the turner roll 46*a*, and deflected in a direction opposed to the direction of rotation of said turner roll. In this latter regard, the air-directing section 62 controls the flow of air past the turner roll 46*a* in a manner similar to that in which the feed roll baffle arrangement 34 controls the flow of air past the turner roll 46. Most preferably, the downstream edge 69 of the air-directing section 62 underlies the turner roll 46*a*. Reference in this application to the fact that the downstream edge of the air-directing section underlies the turner roll means that a line drawn from the axis of rotation of the main drum 14 tangent to the downstream edge of the air-directing section 62 will intercept the periphery of the turner roll 46*a*, as indicated in phantom at 70 in FIG. 1. The air-directing section 62** need not be cylindrical in configuration. However, in the most preferred embodiment of this invention the upstream curved segment of the air-directing section has a convex curvature for splitting the air flow intercepted by it.

Preferably, the turner roll **46*a* is closer to the main drum 14 than it is to the worker roll 60*a*. The worker roll 60*a* is closer to the turner roll than it is to the main drum. This positional arrangement sets up a static pressure profile in the working area 52 which encourages the flow of air adjacent the periphery of the main drum. In a preferred embodiment of the invention the peripheries of the turner roll 46*a* and the main drum 14 are spaced 0.030 inches apart, the peripheries of the turner roll 46*a* and worker roll 60*a* are spaced 0.035 inches apart and the peripheries of the worker roll 60*a* and main drum 14** are spaced 0.045 inches apart.

In order to prevent an undesirably large pressure drop from the upstream end of the turner roll **46*a* to the downstream end of the worker rolls 60*a* a passageway 72 is provided in the top wall 74 of a housing positioned about the working section 16. This passageway permits air from the surrounding atmosphere to enter the working section downstream of the baffle 54. The passageway 72 is included in a region of the housing between the worker roll 60*a* and the exit end of the working section 16, and a flow of atmospheric air, indicated by arrow 75, is drawn through the passageway adjacent the downstream end of the worker roll 60*a* by the pumping action created by the high speed rotation of the main drum 14. Most preferably the passageway 72 extends for the entire cross-machine-direction of the apparatus 10, and is provided in the top wall 74 of the housing downstream of the intersection, with the top wall 74, of a plane which passes through the axes of rotation of the main drum 14 and the worker roll 60*a*. This plane is indicated by the phantom line 76 in FIG. 2. By permitting atmospheric air to communicate with the working area 52 adjacent the worker roll 60*a* the static pressure at that location is increased. This prevents air flow over the turner roll 46a and the worker roll 60a in a direction opposed to the direction of fiber movement on said turner and worker rolls. The advantage of controlling the air flow in this manner is the same as controlling the air flow around the first set of satellite rolls 56**.

The housing about the working section 16 seals the working section from the atmosphere, except in the region of passageway 72. Moreover, the baffle 54 extends for the entire cross-machine-direction and is sealed to the housing between the working areas 50 and 52. The arrangement between the housing and the baffle separates the action of the satellite rolls in the working area 50 from the action of the satellite rolls in the working area 52. Moreover, the seal provided about the working section 16 by the housing aids in preventing uncontrolled air flow into said working section.

Referring to FIGS. 1 and 2, a seal roll 80, which is similar in construction to the turner rolls 46 and 46a, is positioned downstream of worker roll 60a to confine the air flow on the periphery of the main drum 14 for passage to the release zone 18. The teeth of the seal roll are provided with a positive rake, and the periphery of the seal roll is rotated at a considerably slower speed than the periphery of the main drum 14. The arrangement of the teeth on the main drum 14 relative to the teeth on the seal roll 80 prevents the seal roll from picking fibers off the periphery of the main drum as said main drum conveys the fibers past the periphery of said seal roll. It is understood that the seal roll 80 is one means of confining the air flow on the periphery of the main drum 14; however, other seal means, such as a stationary plate, could be utilized.

It is highly desirable to provide a smooth, uniform, cross-machine-direction profile of the air-fiber stream as it is directed out of the working section 16 into the release zone 18. Such a uniform profile contributes to more uniform formation of a fibrous web, or mat 24, on the forming surface 23. To achieve a more uniform cross-machine-direction flow the air-fiber stream is accelerated as it is directed into the release zone 18 from the working section 16. In order to accomplish this result a guide plate 82 is positioned close to the periphery of the seal roll 80, and includes a lower surface 84 which is spaced from the periphery of the main drum 14 to provide a confining channel through which the air-fiber stream is directed (FIGS. 1 and 2). Preferably, the lower surface 84 of the guide plate is positioned approximately 0.375 inches from the outer periphery of the main drum 14. In order to accelerate the flow as it is directed into the release zone 18, a lip member 86 (FIG. 2) is attached to the upper surface of the guide plate 82, and includes a lower edge 88 which is spaced closer to the periphery of the main drum than the lower surface 84 of the guide plate 82 (FIG. 2). As a result of the above construction the guide plate 82 and the lip member 86 cooperate with the outer periphery of the main drum 14 to provide a flow-accelerating nozzle for the air and fibers. This acceleration smooths out the cross-machine-direction profile of the flow, and thereby contributes to more uniform formation of a fibrous web, or mat 24 on the forming surface 23.

Preferably, the lower edge 88 of the lip member 86 has a convex curvature in the cross-machine-direction (not shown). This construction provides an exit between the lower edge 88 of the lip member and the outer periphery of the main drum 14 which is deeper in the central region than at the marginal ends. This configuration prevents excessively high basis weight formation of the longitudinal edges of the fibrous mat 24 formed on the forming surface 23. In other words, the formed mat 24 has a more uniform basis weight across its entire width than it would otherwise have if the exit between the lip member 86 and the main drum 14 were of a substantially uniform thickness for the entire extent of the cross-machine-direction. If desired, the lower edge of the lip member can be provided with a nonlinear profile other than a convex curvature to provide different depth along the cross-machine-direction of the nozzle exit. In this manner the cross-machine-direction basis weight of a formed fibrous structure can be varied in a controlled manner.

Referring again to FIGS. 1 and 2, pressurized air is directed through a conduit 92, and is deflected by an adjustable flap 94 toward the periphery of the main drum 14 adjacent the lower edge 88 of the lip member 86. By directing pressurized air against the periphery of the main drum premature separation of fibers from said periphery is avoided. This serves to partially control the path of fiber flow to the foraminous forming surface 23. As indicated above, the flap 94 is adjustable, and can be positioned in any desired orientation to provide the proper direction of air flow from the conduit 92 into engagement with the periphery of the main drum 14. In accordance with a preferred operation of this apparatus a forward edge 96 of the flap 94 (FIG. 2) is positioned less than 1 inch away from the lower edge 88 of the lip member 86. Most preferably the spacing between the edge 96 of the flap and the edge 88 of the lip member is about three-fourth inch.

As the main drum 14 rotates into its vertically extending fiber release zone 18 a majority of the air-fiber flow will be projected from the peripheral surface of said main drum by centrifugal force. Some of the textile-length fibers will remain hooked on the teeth of the main drum; however, almost all of the papermaking length fibers will be projected from the periphery of said drum. Thereafter, the flow will be directed through the formation chamber 20 onto the foraminous forming surface 23. The pressure differential established through vacuum box 22 aids in directing the flow to the forming surface.

Figure 4:
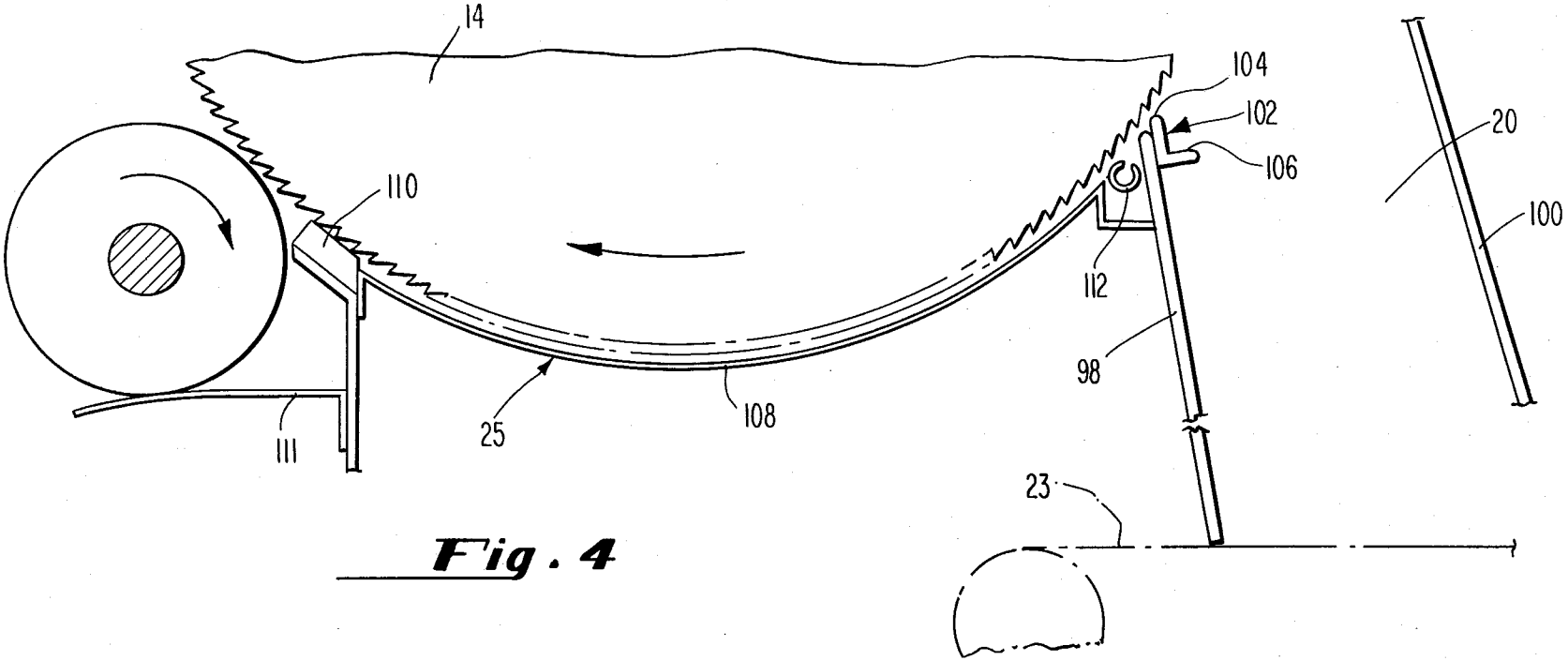
FIG. 4 is an enlarged view of the unique seal arrangement employed in the apparatus and method of this invention.

Referring to FIGS. 1 and 4, the formation chamber 20 includes a back wall 98 and a front wall 100. A doffing member 102 extends for the entire cross-machine-direction of the apparatus 10, and has an upper edge 104 positioned extremely close to the periphery of the main drum 14 without interfering with the rotation of said drum. Preferably, the upper edge 104 is positioned at about 0.010 inches from the periphery of the main drum. The upper edge 104 of the doffing member 102 will intercept any air-fiber flow adjacent the periphery of the main drum as said periphery is directed past the doffing member. The intercepted air-fiber flow will be deflected, or doffed, from the periphery of the main drum 14 into the formation chamber 20 for deposition on the formanious forming surface 23. An outwardly directed ledge 106 of the doffing member 102 serves to further deflect the flow of air and fibers moving into the formation chamber 20 to aid in controlling the path of travel of the air-fiber flow as said flow moves to the forming surface 23.

Although the doffing member 102 is effective in intercepting and removing air-fiber flow which is close to the periphery of the main drum, it is not effective in removing air which settle between the teeth of the main drum; nor is it effective in removing some of the textile-length fibers which are hooked to the teeth of said drum. It has been found that approximately 10–20% of the long fiber content, by weight, is lost from the apparatus 10 in the absence of an effective seal arrangement adjacent the lower periphery of the main drum 14 between the release zone 18 and the inlet section 12. The long fiber content is lost by its release from the teeth of the main drum 14 beyond the doffing member 10, resulting from high speed rotation of said main drum.

Referring to FIGS. 1 and 4, the unique seal arrangement 25 of this invention is provided to prevent the textile-length fibers from remaining hooked on the teeth of the main drum as the teeth move past the doffing member 102. The seal arrangement 25 also is effective in removing air which settles between the teeth of the main drum prior to the conveyance of said air into the inlet section 12 by the high speed rotation of the main drum 14.

The seal arrangement 25 includes a lower housing wall 108 positioned close to the periphery of the main drum 14 between the formation chamber 20 and the inlet section 12. A disposable seal pad 110 is positioned in engagement with the toothed periphery of the main drum 14 adjacent the lower feed roll 26 at the inlet section 12. Although not required, it is desirable to provide a flexible seal member 111, in the form of an elongate plate, engaging the outer periphery of the lower feed roll **26*a* outside of the nip which engages the fibrous feed 13. This seal member 111 provides a support for fibers which are lost from the fibrous feed 13, or which are directed past the seal pad 110 by a flow induced by the high speed rotation of the main drum 14**.

The disposable seal pad 110 preferably is formed of a material which can be engaged by the teeth of the main drum 14 without damaging said teeth. A preferred material for use as a seal pad is high density polyethylene. The disposable seal pad 110 creates a back pressure at the doffing member 102, and this back pressure helps doff the textile-length fibers from the teeth of the main drum for conveyance to the forming surface 22. It has been found that the use of seal pad 110 eliminates a significant loss of textile-length fibers from the apparatus. Prior to the inclusion of the seal pad in the apparatus 10, some of the textile-length fibers which were hooked by the teeth of the main drum 14 were directed past the formation chamber 20 and escaped from the apparatus adjacent the inlet section 12. Although the seal pad 110, by itself, provides a significant reduction in the loss of long fibers during the mat forming operation, it funnels air trapped between the teeth of the main drum 14 under the lower feed roll **26*a*, and into the nip provided between said feed roll and the main drum 14. This disturbs the integrity of the fibrous feed 13, and causes said feed to move in an intermittent fashion into engagement with the toothed periphery of the main drum 14. This adversely affects the uniformity of the machine-direction basis weight of the fibrous mat 24**.

A gas nozzle 112 is positioned behind the back wall 98 of the formation chamber 20. This nozzle directs high pressure gas (preferably air) against the periphery of the main drum 14; generally in the region where the upper edge 104 of the doffing member 102 is adjacent the periphery of said main drum. During high speed operation of the device a blower means (not shown) is connected to the nozzle for directing the gas through an outlet provided by spaced-apart orifices in said nozzle. The static pressure of the gas directed through the nozzle outlet is that which is necessary to remove air which is trapped between the teeth of the main drum as said drum is being rotated. This prevents the air trapped between the teeth of the main drum 14 from being conveyed to the inlet section 12 of the apparatus 10. Preferably the static pressure is maintained at from about two atmospheres to about four atmospheres when the main drum 14 is rotated at over 10,000 feet/minute. Most preferably the static pressure is maintained at about three atmospheres.

In the preferred construction of this invention the air nozzle is a cylindrical tube having a ½ inch diameter central passageway. The orifices are 1/32 inch diameter openings extending through the wall of the tube and spaced in a cross-machine-direction on 154 inch centers. This arrangement permits the establishment of a high static pressure (i.e. high gas velocity) with low volume air flow. Most preferably the volume of air directed through the nozzle 112 is in the range of from about 10 to about 30 standard cubic feet per minute per foot of machine width (SCFM/ft. of machine width). Higher volumes of air tend to adversely effect the operation of the apparatus by preventing proper control of the fiber movement through said apparatus.

As indicated earlier, the laminate feed 13, in accordance with the preferred embodiment of this invention, includes a loosely compacted upper layer 28 of textile-length fibers greater than one-fourth inch in length, and a loosely compacted bottom layer 30 of short cellulosic fibers of a papermaking length less than one-fourth inch; preferably wood pulp fibers. It has been found that the laminate feed 13 can be most reliably directed into engagement with the toothed periphery of the main drum 14 by engaging the opposed flat surfaces of the laminate feed with moving feed surfaces, such as the outer peripheries of the upper and lower feed rolls 24 and 26, respectively. Most preferably, the upper feed roll 26 includes projections, such as teeth or pins, on its outer periphery for positively engaging the upper layer 28 of textile-length fibers. The lower feed roll **26*a*** preferably is knurled or smooth surfaced.

Considerable difficulty is encountered in attempting to feed the laminate 13 over a stationary surface, such as the supporting surface of a stationary nose bar. When the laminate feed 13 is directed over a stationary surface it encounters sheer forces which cause it to buckle. This impairs the uniformity with which fibers are presented to the toothed periphery of the main drum 14, and thereby effects the uniformity of the fibrous mat 24 which is ultimately formed on the forming surface 23.

It has been found that the most effective individualization of the fibers in the laminate feed 13 is achieved by positioning the short fiber layer so that it is the first layer to be engaged by the teeth of the rotating main drum 14. In the embodiment shown and described in this application the short fiber layer 30 is the bottom layer, and is initially engaged by the teeth of the main drum 14 as said main drum is rotated in a clockwise direction (FIG. 1). The reasons believed to be responsible for this fact are set forth in detail in the earlier-referenced Gotchel-Norton application, and will not be repeated herein.

In accordance with the preferred method of this invention the formed fibrous structure 24 includes a preponderance, by weight, of short cellulosic fibers under one-fourth inch in length. The ratio of the basis weight of the short fiber layer 30 to the basis weight of the long fiber layer 28 is chosen to equal the ratio of the percent short fibers, by weight, to the precent long fibers, by weight, which is desired in the fibrous structure 24. A preferred basis weight range for the short fiber layer is from about 18–50 oz/yd², with the basis weight of the long fiber layer 28 being dictated by the weight percent of long fibers to be included in the fibrous structure 24.

Preferably the main drum 14 is rotated at a surface speed in excess of 10,000 feet/minute, and most preferably at a speed in excess of 13,000 feet/minute. The fibers separated from the laminate feed 13 are conveyed to the working section 16 by the rotation of the main drum 14. As the fibers are conveyed through the working section they are intimately worked between the main drum 14 and the cooperating sets of satellite rolls 56 and 58. This intimate working of the fibers insures that a high degree of individualization of said fibers is achieved. After the fibers have been worked between the main drum 14 and the sets of satellite rolls 56 and 58, they are directed beneath the seal roll 80, and past the guide plate 82 and lip member 86. As explained earlier, the flow of individualized fibers is accelerated as it is directed past the guide plate 82 and the lip member 86 into the fiber release zone 18. The fibers are then directed into the formation chamber 20, and the pressure differential established from behind the forming surface 23 through vacuum box 22 is effective to direct the fibers onto said forming surface in the form of a fibrous mat 24. The seal arrangement 25 is provided to prevent the loss of long fibers and to prevent air flow trapped between the teeth of the main drum 14 from interferring with movement of fibrous feed 13 into the inlet section 12.

Most preferably the speed of the forming surface 23 is controlled to form a feed mat 24 having a basis weight in the range of from about 12 to about 50 oz/yd². The fibrous feed mat 24 can then be fed directly to the infeed section of a web former which is adapted to form a low basis weight fibrous web in the range of from about 1 oz/yd² to about 6 oz/yd², in the manner disclosed in U.S. Pat. No. 3,862,472, and referred to earlier in this application.

Having described our invention, we claim:

1. A method for forming a fibrous structure from a fibrous feed that includes textile-length fibers over one-fourth inch in length, said method including the steps of:

A. rotating a drum having projections on its outer periphery;

B. directing the fibrous feed into engagement with the rotating outer periphery of the drum, whereby rotation of the drum past the fibrous feed separates fibers from said feed;

C. directing separated fibers to a release zone on the drum at which the separated fibers are released from the periphery of said drum for subsequent conveyance to a foraminous forming surface upon which the fibrous structure is formed, said separated fibers being directed to the release zone by rotation of the drum; and D. sealing the outer periphery of the drum in a region between the fiber release zone and the section in which the fibrous feed is directed into engagement with the periphery of said drum, the sealing of said drum being carried out by;

1. directing a gas against the outer periphery of the drum with a force component in a direction opposed to the direction of rotation of the drum, said gas being directed through the outlet of a nozzle at a static pressure of at least about two atmospheres to provide a gas velocity which is sufficiently high to remove air trapped between the projections of the drum as said drum is being rotated, and 2. providing a seal pad in engagement with the outer periphery of the drum, said seal pad being spaced, in the direction of rotation of said drum, from the region on the outer periphery of the drum against which the gas is impinged, said seal pad aiding in preventing the loss of textile-length fibers from the process.

2. The method according to claim 1, wherein the step of directing the gas against the outer periphery of the drum is accomplished by directing the gas through the outlet of a nozzle at a static pressure of from about two atmospheres to about four atmospheres.

3. The method according to claim 2, including rotating said drum so that its periphery moves at a surface speed in excess of 10,000 feed per minute.

4. The method according to claim 3, wherein the fibrous feed is a laminate including a loosely compacted upper layer of textile-length fibers greater than one-fourth inch in length, and a loosely compacted lower layer of short cellulosic fibers less the one-fourth inch in length, whereby the step of directing the fibrous feed into engagement with the outer periphery of the drum is accomplished by engaging opposed surfaces of said feed with movable feed surfaces.

5. The method according to claim 1, including establishing a pressure differential through the foraminous forming surface for aiding in directing fibers to said surface to form the fibrous structure.

6. The method according to claim 1, including the step of directing a flow of gas against the outer periphery of the drum in the release zone for aiding in controlling the path of travel of fibers from the release zone to the foraminous forming surface.

7. The method according to claim 4, including the step of depositing the fibers on the formainous forming surface in the form of a fibrous mat of blended textile-length fibers and short cellulosic fibers.

8. The method according to claim 1, wherein the step of directing the gas against the outer periphery of the drum is accomplished by directing the gas through the outlet of a nozzle at a volume of from about 10 to about 30 standard cubic feet per minute per foot of machine width.

9. A method for forming a fibrous structure from a fibrous feed, said method including the steps of:

A. rotating a drum having projections on its outer periphery so that said periphery moves at a surface speed in excess of 10,000 feet per minute;

B. directing the fibrous feed into engagement with the rotating outer periphery of the drum, whereby rotation of the drum past the fibrous feed separates fibers from said feed;

C. directing separated fibers to a release zone on the drum at which the separated fibers are released from the periphery of said drum for subsequent conveyance to a foraminous forming surface upon which the fibrous structure is formed, said separated fibers being directed to the release zone by rotation of the drum; and D. sealing the outer periphery of the drum in a region between the fiber release zone and the section in which the fibrous feed is directed into engagement with the periphery of said drum, the sealing of said drum including the step of directing a gas through the outlet of a nozzle at a static pressure of from about two atmospheres to about four atmospheres against the outer periphery of the drum with a force component in a direction opposed to the direction of rotation of the drum to provide a gas velocity which is sufficiently high to remove air trapped between the projections of the drum as said drum is being rotated.

10. A method for forming a fibrous structure from a fibrous feed, said method including the steps of:

A. rotating a drum having projections on its outer periphery so that said periphery moves at a surface speed in excess of 10,000 feet per minute;

B. directing the fibrous feed into engagement with the rotating outer periphery of the drum, whereby rotation of the drum past the fibrous feed separates fibers from said feed;

C. directing separated fibers to a release zone on the drum at which the separated fibers are released from the periphery of said drum for subsequent conveyance to a foraminous forming surface upon which the fibrous structure is formed, said separated fibers being directed to the release zone by rotation of the drum; and D. sealing the outer periphery of the drum in a region between the fiber release zone and the section in which the fibrous feed is directed into engagement with the periphery of said drum, the sealing of said drum including the step of directing a gas through the outlet of a nozzle at a static pressure of at least about two atmospheres against the outer periphery of the drum with a force component in a direction opposed to the direction of rotation of the drum to provide a gas velocity which is sufficiently high to remove air trapped between the projections of the drum as said drum is being rotated.

11. The method according to claim 10, wherein the step of directing the gas against the outer periphery of the drum is accomplished by directing the gas through the outlet of the nozzle at a volume of from about 10 to about 30 standard cubic feet per minute per foot of machine width.

* * * * *